US005387101A

United States Patent [19]

Chan

[11] Patent Number: 5,387,101

[45] Date of Patent: Feb. 7, 1995

[54] CIGARETTE LIGHTERS

[75] Inventor: Leung Chan, Shatin, Hong Kong

[73] Assignee: The Cli-Claque Company Ltd., New Territories, Hong Kong

[21] Appl. No.: 93,003

[22] Filed: Jul. 19, 1993

[30] Foreign Application Priority Data

Jul. 24, 1992 [GB] United Kingdom ..... 9215726

[51] Int. Cl.[6] ..... F23D 11/36

[52] U.S. Cl. ..... 431/153; 431/271; 431/255; 431/274

[58] Field of Search ..... 431/277, 255, 274, 153; 222/153, 402.11

[56] References Cited

U.S. PATENT DOCUMENTS

| | | | |
|---|---|---|---|
| 1,895,032 | 1/1933 | Fisher . | |
| 2,520,328 | 8/1958 | Nissen . | |
| 3,169,672 | 2/1965 | Soffer et al. . | |
| 3,756,766 | 9/1973 | Green | 431/254 |
| 3,898,031 | 8/1975 | Rusakowicz | 431/153 X |
| 3,899,286 | 8/1975 | Lockwood et al. | 431/152 |
| 3,938,943 | 2/1976 | Malamoud | 431/150 |
| 4,036,579 | 7/1977 | Marynissen | 431/131 |
| 4,758,152 | 7/1988 | Kordecki | 431/153 |
| 4,784,601 | 11/1988 | Nitta | 431/153 |
| 4,784,602 | 11/1988 | Nitta | 431/153 |
| 4,786,248 | 11/1988 | Nitta | 431/255 |
| 4,822,276 | 4/1989 | Bisbee | 431/153 |
| 4,830,603 | 5/1989 | Cirami | 431/153 |
| 4,832,596 | 5/1989 | Morris, Sr. | 431/153 |
| 5,002,482 | 3/1991 | Fairbanks et al. | 431/277 |
| 5,074,781 | 12/1991 | Fujita | 431/153 |
| 5,165,885 | 11/1992 | Iwahori | 431/153 |
| 5,165,886 | 11/1992 | Frigiera | 431/277 X |
| 5,197,870 | 3/1993 | Yang | 431/153 |
| 5,213,493 | 5/1993 | Iwahori | 431/277 X |
| 5,215,458 | 6/1993 | Cirami | 431/277 |
| 5,224,854 | 7/1993 | Ansquer | 431/277 X |

FOREIGN PATENT DOCUMENTS

| | | |
|---|---|---|
| 2-109706 | 10/1990 | Japan . |
| 1228158 | 4/1971 | United Kingdom . |
| 2062200A | 5/1981 | United Kingdom . |
| WO90/00239 | 1/1990 | WIPO . |

*Primary Examiner*—Larry Jones

*Attorney, Agent, or Firm*—Pollock, Vande Sande & Priddy

[57] ABSTRACT

A cigarette lighter is provided which comprises a tank for a combustible gas under pressure; a valve which is normally closed so preventing exit of the gas from the tank, but which can be opened to allow gas to escape from the tank through a nozzle; a valve actuator which when operated engages and opens the valve; means to produce a spark in the vicinity of the nozzle thereby causing ignition of gas escaping from the tank when the valve is engaged and opened by the valve actuator; a safety device which normally disengages the valve actuator from the valve but which can be selectively operated to move the valve actuator to engage and open the valve.

27 Claims, 5 Drawing Sheets

CIGARETTE LIGHTERS

The present invention relates to a cigarette lighter and in particular to a cigarette lighter with a "self retrieving" safety mechanism whereby accidental operation of the lighter, particularly by a young child, is prevented.

BACKGROUND TO THE INVENTION

Cigarette lighters are known which have safety devices which prevent the accidental operation of the lighter unless the safety device is released. However, such lighters do not necessarily have means whereby the safety device automatically returns to its locking position after the lighter has been operated. Recently lighters have become available with a so-called "self-retrieving" safety mechanism but such lighters are not wholly satisfactory since they are often awkward to operate.

BRIEF SUMMARY OF THE INVENTION

It is an object of the present invention to provide a cigarette lighter with a "self-retrieving" safety mechanism that is simple, easy to operate and which can reliably prevent unintentional use of the lighter. The safety mechanism of the present invention differs from known mechanisms in that it disconnects the valve actuator from the valve rather than simply preventing the downward movement of the valve actuator which still remains in contact with the valve.

In accordance with the invention there is provided a cigarette lighter which comprises a tank for a combustible gas, such as butane under pressure; a valve which is normally closed so preventing exit of the combustible gas from the tank, but which can be opened to allow gas to escape from the tank through a nozzle; a valve actuator which when operated engages and opens the valve; means to produce a spark in the vicinity of the nozzle thereby causing ignition of gas escaping from the tank when the valve is engaged and opened by the valve actuator; a safety device which normally disengages the valve actuator from the valve but which can be selectively operated to move the valve actuator to engage and open the valve; and a resilient means which automatically returns the safety device to the position whereby it disengages the valve actuator from the valve after use of the cigarette lighter.

The safety device is so designed that once a flame has been generated the action of the resilient means returns the safety device to its locking position which "locks" the action of the valve actuator, so it cannot engage and open the valve, ie. a so-called "self-retrieving" action. To use the cigarette lighter again the safety device must be released by being moved against the action of the resilient means to a position whereby the valve actuator engages and opens the valve and gas can be released and ignited—such an action is difficult for a young child and it also prevents accidental operation of the cigarette lighter by its being caught on clothing etc.

A particularity preferred embodiment of the safety device will be described in detail in conjunction with the drawings. It consists of a substantially cylindrical body having an upwardly projecting pin which is adapted to be located within a slot in the underside of the valve actuator, a downwardly projecting leg to which is attached one end of a horizontally disposed resilient means in the form of a spring and an operating lever which in operation is moved against the action of the resilient means along a slot in a collar mounted on the tank past a cam to lodge in an upward extension of the slot thereby causing the valve actuator to move and to engage the valve. The other end of the resilient means is attached to the tank cover.

It has been found to be advantageous to provide a spring around the upwardly projecting pin of the safety device to stabilize the valve actuator.

BRIEF DESCRIPTION OF THE DRAWINGS

The present invention will be described, by way of example, with reference to the accompanying drawings, in which.

DESCRIPTION OF THE PREFERRED EMBODIMENT

Figure 1:
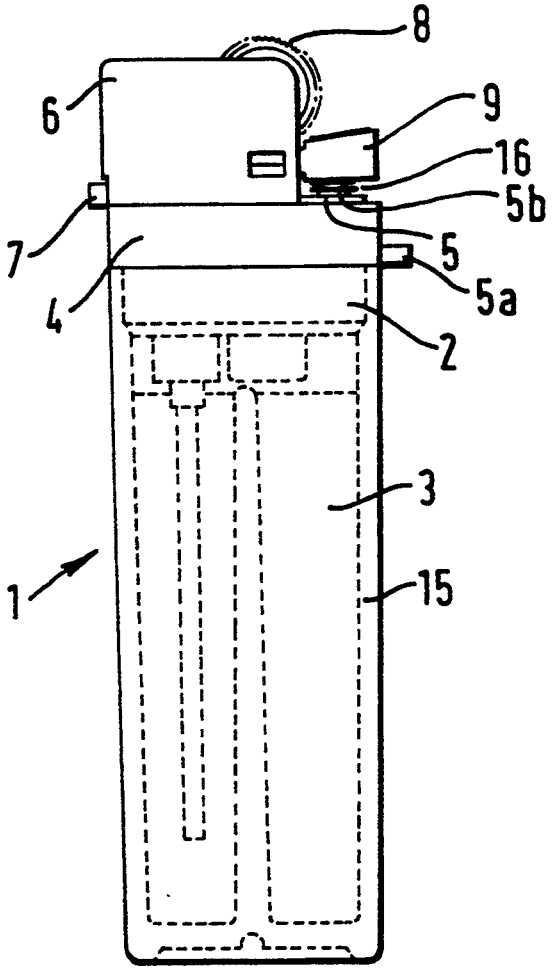
FIG. 1 is a side view of a cigarette lighter in accordance with the present invention.

As shown in FIG. 1 the cigarette lighter of the present invention shown generally as 1 comprises a tank 15 for a combustible gas 3. Located within the top of the tank 15 is tank cover 2 shown in detail in FIG. 5. Mounted on the tank 15 a collar 4. A metal cap or windshield 6 is located on the collar 4 and acts to prevent the flame from being extinguished when the cigarette lighter 1 is operated. Also, shown in FIG. 1 is a safety device 5, a spring 16, a valve actuator 9, a spark producing wheel 8 and lever 7 which operates a mechanism to adjust the height of the flame. Depression of the valve actuator 9 permits fuel to flow through a valve 12 (see FIG. 2 and 3) to be ignited by sparks produced by the wheel 8 engaging a flint 11 (see FIGS. 2 and 3). When the safety device 5 is in its locking position it disengages valve actuator 9 from valve 12 and so depression of the valve actuator 9 will not open the valve 12 and therefore the gas 3 cannot flow from the tank 15 and no flame is produced.

Figure 2:
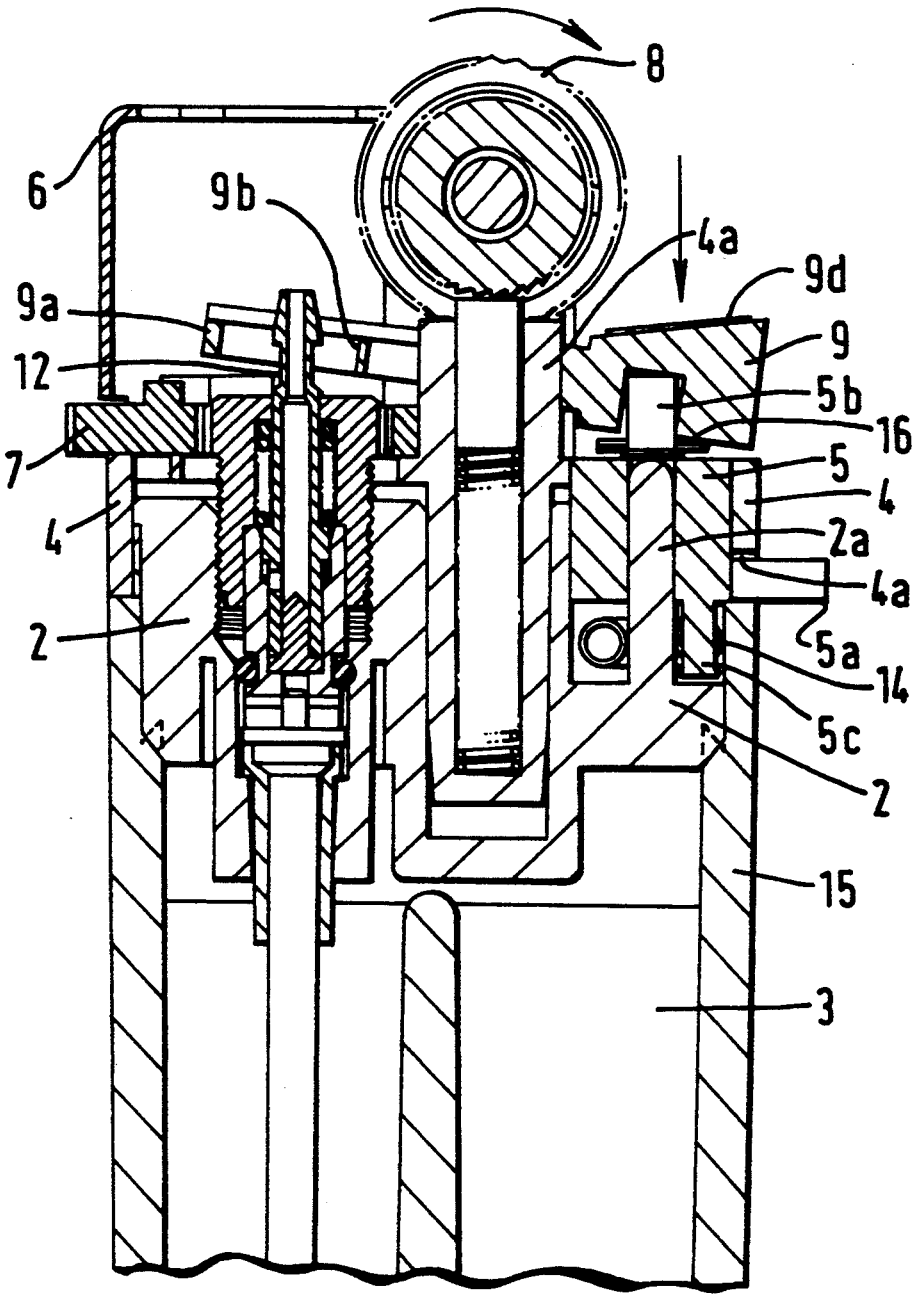
FIG. 2 is a vertical section through the cigarette lighter of FIG. 1 with the safety device in its locking position.

In FIG. 2, the safety device 5 is in its locking position whereby the valve actuator 9 is disengaged from valve 12, ie. valve 12 is not located within a recess 9*a* of the valve actuator (see in particular FIG. 6*a* and 6*b*) but is located in space 9*b* and so depression of the finger plate 9*d* of the valve actuator 9 fails to engage and open the valve 12. Also, shown in this Figure is a spring 14 one end of which is attached to leg 5*c* of the safety device 5 and the other end of spring 14 is attached to a peg 2*b* (shown in FIG. 5) which forms part of tank cover 2; the spring 14 resiliently biasing the safety device 5 to its locking position. The safety device 5 is also provided with a pin 5*b* which is located within a slot 9*c* of the valve actuator 9 and an operating lever 5*a* located within horizontal slot 4*a* of collar 4. The spring 16 is coiled around guide pin 5*b* to stabilize the valve actuator 9.

Figure 3:
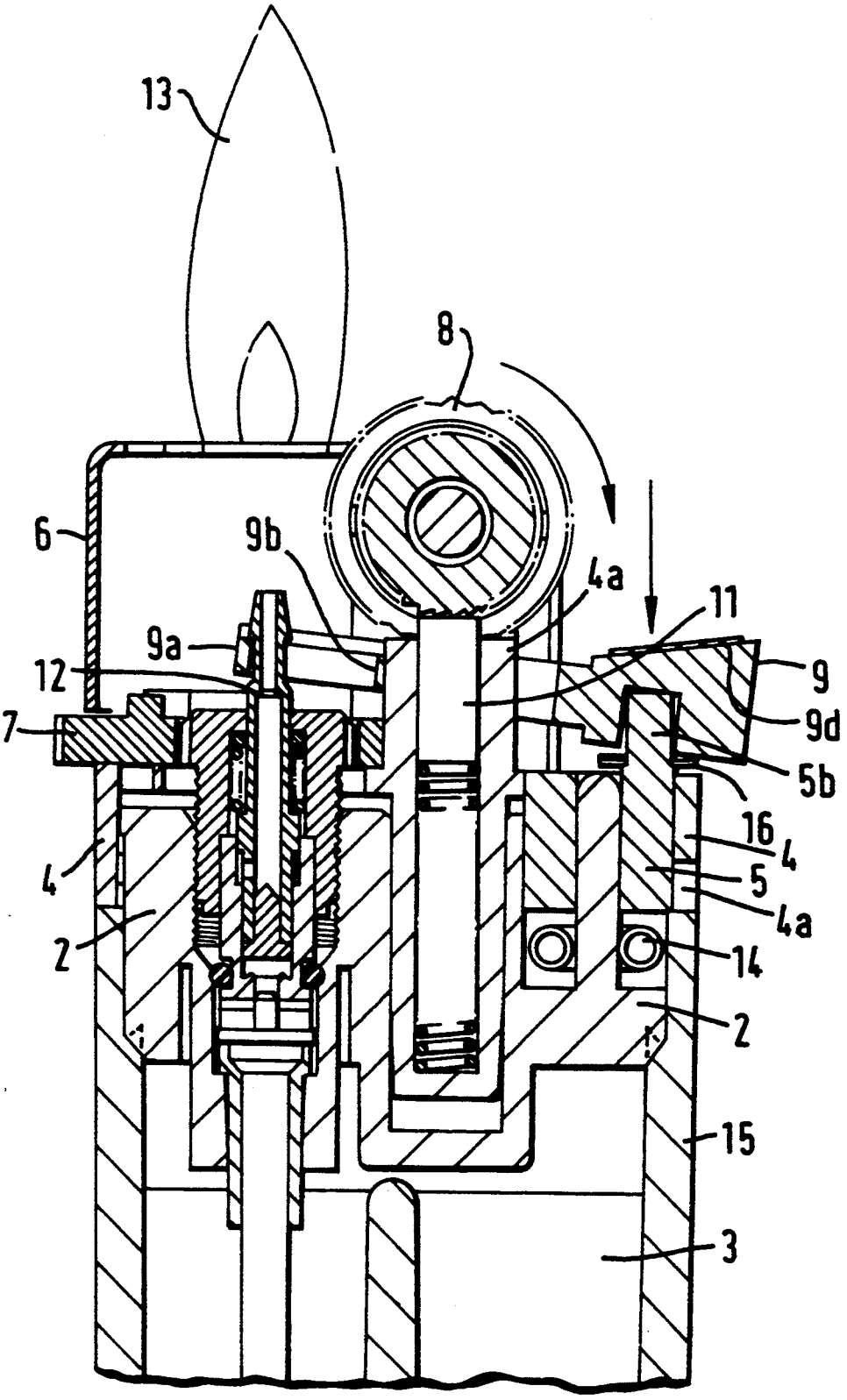
FIG. 3 is a vertical section through the cigarette lighter of FIG. 1 with the safety device released.

In FIG. 3, the operating lever 5*a* has been moved along horizontal slot 4*a* into vertical slot 4*b* (see FIGS. 6 and 7), causing the valve actuator 9 to move into a position whereby valve 12 engages recess 9*a* of the valve actuator 9 and manual depression of finger plate 9*d* of the valve actuator 9 and simultaneous rotation of spark wheel 8 causes the valve 12 to open, gas 3 to flow, a spark to be generated by the spark wheel 8 rubbing the flint 11 and a flame 13 to be generated at nozzle 12*a* of the valve 12.

As the valve actuator 9 is depressed the safety device 5 moves back to its locking position (as shown in FIG. 2) under the action of spring 14.

Figure 4:
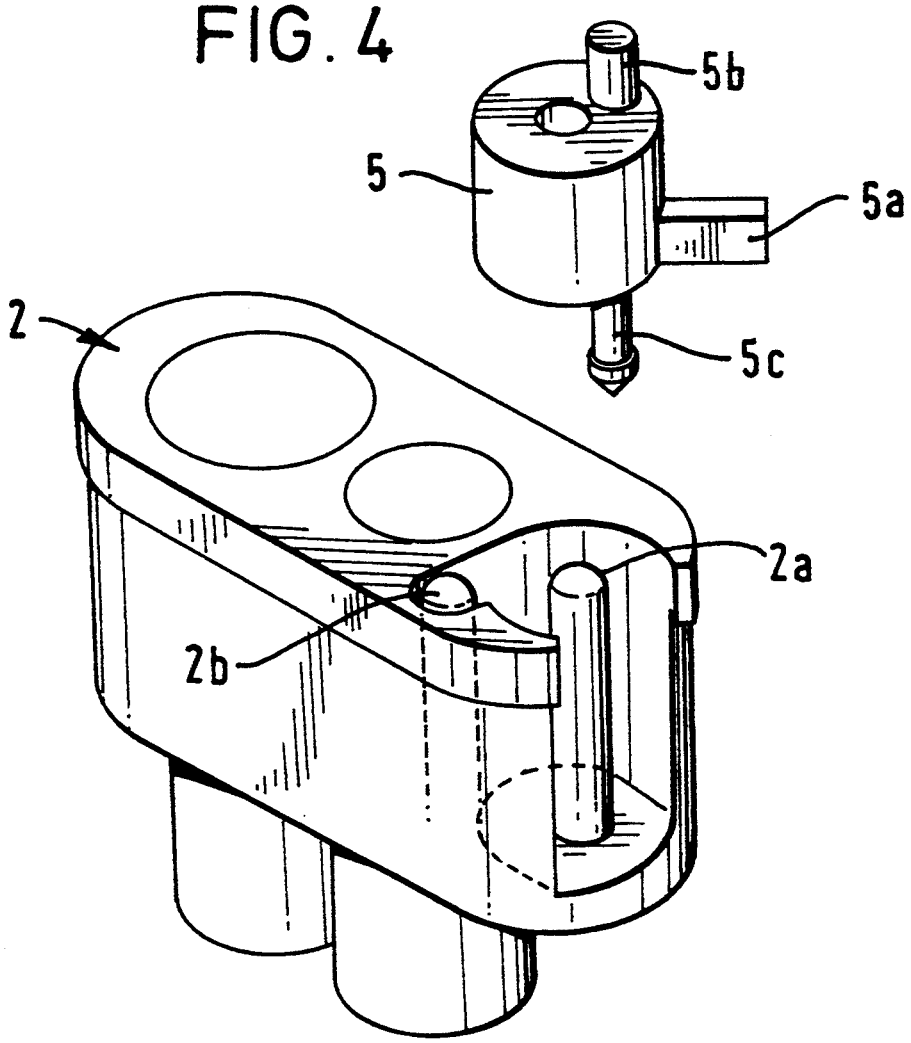
FIG. 4 is a semi-exploded perspective view of the safety device, and tank cover
Figure 5:
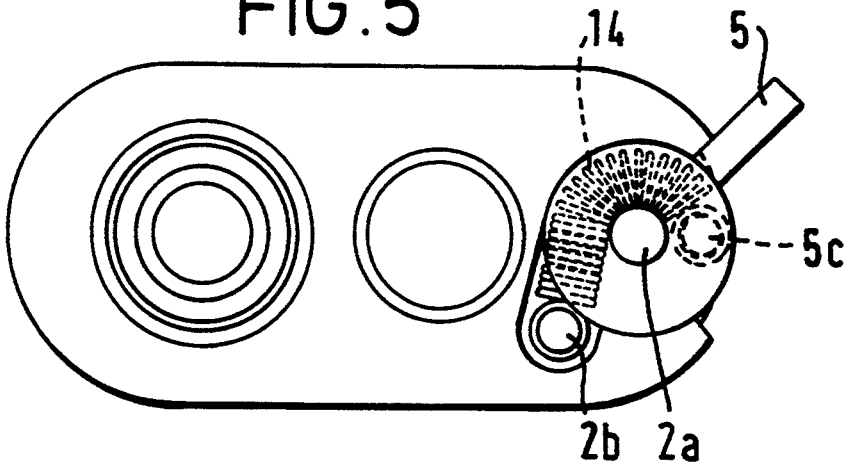
FIG. 5 is a plan view of the tank cover with the safety device
Figure 6A:
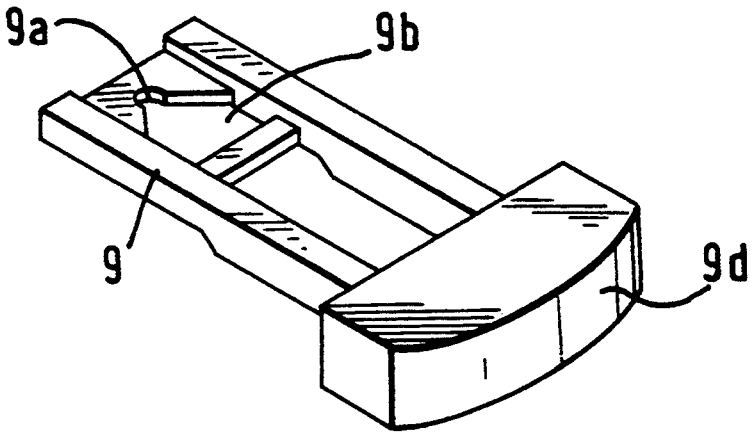
FIG. 6*a* is a perspective view of the valve actuator from above.
Figure 6B:
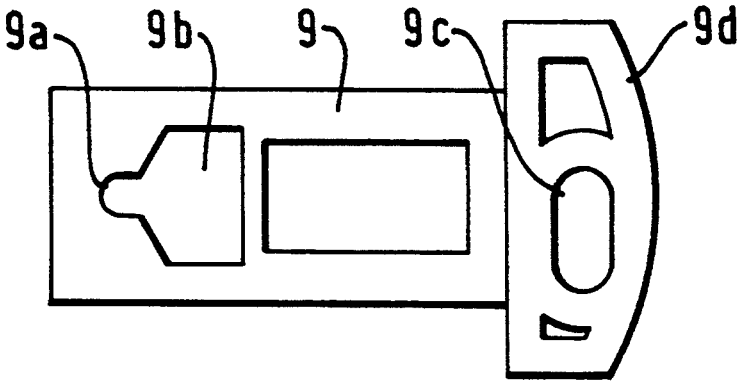
FIG. 6*b* is a view of the underside of the valve actuator.

The safety device and tank cover are shown in detail in FIGS. 4 and 5. The safety device comprises the main cylindrical body 5, guide pin 5*b* which locates in slot 9*c* of the valve actuator 9, leg 5*c* to which is attached one end of spring 14 and an operating lever 5*a*. The tank cover 2 comprises upstanding pegs 2*a* and 2*b* and as shown in FIG. 5 one end of spring 14 is attached to leg 5*c* of the safety device and the other end of spring 14 is attached to peg 2*b* of tank cover 2.

The valve actuator 9 is shown in detail in FIGS. 6(*a*) and (*b*) and comprises a finger plate 9*d*, a slot 9*c* for receiving guide pin 5*b* of the safety device 5, space 9*b* which receives valve 12 when the safety device is locked and recess 9*a* which receives valve 12 when the safety device 5 is released. When the safety device 5 is released the guide pin 5*b* travels along slot 9*c*, so causing the valve actuator 9 to move along a horizontal axis, so causing the recess 9*a* to receive valve 12.

Figure 7:
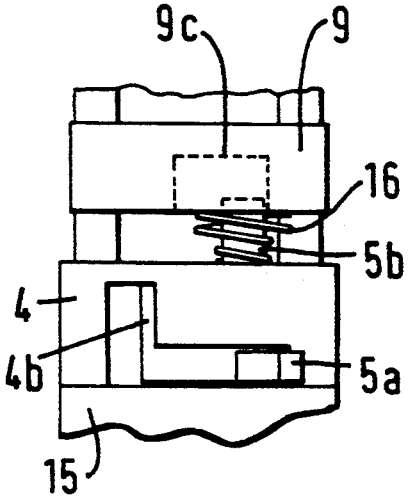
FIG. 7 is a front view of the cigarette lighter of FIG. 1 with the safety device in its locking position.
Figure 8:
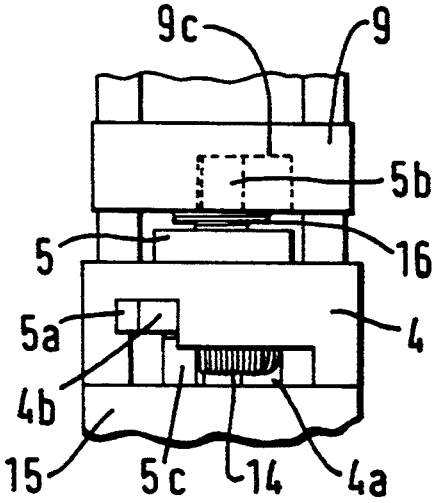
FIG. 8 is a front view of the cigarette lighter of FIG. 1 with the safety device released.

In FIG. 7, the safety device 5 is shown in its locking position in which it is acting to prevent operation of the cigarette lighter. Lever 5*a* is held at the furthest right part of slot 4*a* under the action of spring 14 and pin 5*b* is at the furthest right part of slot 9*c* of valve actuator In FIG. 8, the safety device 5 is shown in its released position, in which the cigarette lighter can now be operated. Lever 5*a* has been moved against the action of spring 14 along slot 4*a* and into slot 4*b*. At the same time pin 5*b* moves along slot 9*c* of valve actuator 9 to the furthest left position, so causing valve actuator 9 to engage valve 12 in recess 9*a*.

A latitude of modification, change and substitution is intended in the foregoing disclosure and in some instances some features of the invention will be employed without a corresponding use of the other features. Accordingly, it is appropriate that the appended claims be construed broadly and in a manner consistent with the spirit and scope of the invention herein.

I claim:

1. A cigarette lighter comprising:

a tank for a combustible gas under pressure;

a valve which is normally closed, thus preventing exit of the combustible gas from the tank, but which can be opened to allow gas to escape from the tank through a nozzle;

a valve actuator which when operated engages and opens the valve;

spark means operable to produce a spark in the vicinity of the nozzle thereby causing ignition of gas escaping from the tank when the valve is engaged and opened by the valve actuator;

a finger plate for a user to engage with the user's finger to cause opening of said valve when said spark means is operated;

a moveable safety device having an operating member separate from said finger plate, for a user to engage with the user's finger, a normal first position in which the safety device disengages the valve actuator from the valve and a second position, to which the safety device can be moved with the operating member, in which the safety device engages the valve actuator to engage and open the valve; and a resilient means which automatically disengages the valve actuator from the valve after use of the cigarette lighter.

2. A cigarette lighter according to in claim 1 wherein the resilient means is connected with the safety device for causing the safety device to disengage the valve actuator from the valve after use of the cigarette lighter.

3. A cigarette lighter according to claim 1 wherein a collar is mounted on the tank, the collar has a slot with an upward extension, and wherein the operating member, when in use, is movable against the action of the resilient means along the slot into the upward extension thereof thereby causing the valve actuator to engage the valve.

4. A cigarette lighter according to in claim 3 wherein, when said finger plate is engaged by the user's finger, the downward operable motion of the finger plate causes the operating member to dislodge from the upper extension and said resilient means automatically returns said operating member and safety device to a position which causes the valve actuator to disengage the valve.

5. A cigarette lighter according to claim 1 wherein the valve actuator has first and second positions in which it respectively is and is not in operative engagement with the valve, and the valve actuator includes a cut-out portion which surrounds the valve when the valve actuator is not in operative engagement with the valve.

6. A cigarette lighter according to claim 5 wherein the cut-out portion includes a recess which engages the valve when the valve actuator is in operative engagement with the valve.

7. A cigarette lighter according to claim 1 wherein the resilient means is a spring.

8. A cigarette lighter according to claim 1 wherein the operating member is a lever.

9. A cigarette lighter according to claim 1 wherein the tank is provided with a cover with two upstanding pegs.

10. A cigarette lighter according to claim 9 wherein the resilient means has one end which is attached to one of said upstanding pegs of the tank cover.

11. A cigarette lighter according to claim 1 wherein the resilient means has one end which is attached to the safety device.

12. A cigarette lighter according to claim 1 wherein a windshield is provided to protect the flame from being extinguished in use.

13. A cigarette lighter according to claim 1 wherein means are provided to adjust the height of the flame.

14. A cigarette lighter according to claim 1 wherein the combustible gas is butane.

15. A cigarette lighter comprising:

a tank for a combustible gas under pressure;

a valve which is normally closed, thus preventing exit of the combustible gas from the tank, but which can be opened to allow gas to escape from the tank through a nozzle;

a valve actuator which when operated engages and opens the valve;

spark means operable to produce a spark in the vicinity of the nozzle thereby causing ignition of gas escaping from the tank when the valve is engaged and opened by the valve actuator;

a moveable safety device comprising a body rotatable about a vertical axis within said lighter and having an upward projection for causing said valve actuator to move said actuator into and out of engagement with said valve; and a resilient means which automatically disengages the valve actuator from the valve after use of the cigarette lighter.

16. A cigarette lighter according to in claim 15 wherein the upward projection is connected with said valve actuator for moving said actuator into and out of engagement with said valve.

17. A cigarette lighter according to in claim 15 wherein the resilient means is connected with the safety device for causing the safety device to disengage the valve actuator from the valve after use of the cigarette lighter.

18. A cigarette lighter according to in claim 15 wherein the movable safety device has a normal first position in which the device disengages the valve actuator from the valve and a second position, to which the device can be moved by a user, in which the device engages the valve actuator to engage and open the valve and the resilient means is connected with the safety device for causing the safety device to return to said first position and disengage the valve actuator from the valve after use of the cigarette lighter.

19. A cigarette lighter according to in claim 15 wherein the safety device comprises a substantially cylindrical body with an upwardly projecting pin adapted to be located within a slot in the under side of the valve actuator.

20. A cigarette lighter according to claim 19 wherein a spring is provided around the upwardly projecting pin of the safety device for biasing the valve actuator upward.

21. A cigarette lighter according to in claim 19 wherein the substantially cylindrical body is mounted in said lighter for rotation about a substantially vertical axis and the upwardly projecting pin is offset radially from said axis.

22. A cigarette lighter comprising:

a tank for a combustible gas under pressure;

a valve which is normally closed, thus preventing exit of the combustible gas from the tank, but which can be opened to allow gas to escape from the tank through a nozzle;

spark means operable to produce a spark in the vicinity of the nozzle thereby causing ignition of gas escaping from the tank when the valve is engaged and opened by the valve actuator;

a finger plate located adjacent a front upper portion of said lighter, for engagement by a user's finger to operate the lighter;

a valve actuator having a connection with said finger plate and mounted for movement within said lighter between valve-engaged and valve-disengaged positions that are respectively movements toward and away from said front upper portion;

a moveable safety device for selectively maintaining said valve actuator in said valve-engaged position; and a resilient means which automatically disengages the valve actuator from the valve after use of the cigarette lighter.

23. A cigarette lighter according to in claim 22 wherein the moveable safety device has a normal first position in which the valve actuator is disengaged from the valve and the finger plate projects a given distance away from the valve and a second position, to which the device can be moved by the user to cause said valve actuator and said finger plate to move within said lighter toward said front upper portion projecting the finger plate a greater distance from the valve for engagement by the user's finger to operate the lighter.

24. A cigarette lighter according to in claim 22 wherein the resilient means is connected with the safety device for causing the safety device to disengage the valve actuator from the valve after use of the cigarette lighter.

25. A cigarette lighter according to in claim 22 wherein the moveable safety device has a normal first position in which the device obstructs the valve actuator from movement into the valve-engaged position and a second position, to which the device can be moved by a user to cause said valve actuator to engage and open the valve.

26. A cigarette lighter according to in claim 22 wherein a collar is mounted on the tank, the collar has a slot with a traverse main portion and an upward extension, and wherein an operating member, connected to the safety device, is movable along the main portion of the slot against the action of the resilient means and into the upward extension and causing the valve actuator to engage the valve, and wherein the resilient means is positioned and connected with the safety device for biasing the operating member against the side of said upward extension for assisting the safety device in selectively maintaining said valve actuator in said valve-engaged position.

27. A cigarette lighter according to in claim 26 wherein, when said finger plate is engaged by the user's finger, the downward operable motion of the finger plate causes the operating member to dislodge from the upper extension and said resilient means automatically returns said operating member and safety device to a position which causes the valve actuator to disengage the valve.

* * * * *